US007402744B1

(12) United States Patent
Wiedemer

(10) Patent No.: US 7,402,744 B1
(45) Date of Patent: Jul. 22, 2008

(54) MIDI FILE STEGANOGRAPHY

(75) Inventor: Matthew Wiedemer, Beaverton, OR (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 454 days.

(21) Appl. No.: 11/151,175

(22) Filed: Jun. 10, 2005

Related U.S. Application Data

(60) Provisional application No. 60/579,478, filed on Jun. 14, 2004.

(51) Int. Cl.
*G10H 7/00* (2006.01)

(52) U.S. Cl. ..... 84/645

(58) Field of Classification Search ..... None
See application file for complete search history.

(56) References Cited

U.S. PATENT DOCUMENTS 7,142,691 B2 * 11/2006 Levy ..... 382/100

* cited by examiner

*Primary Examiner*—Marlon T Fletcher
(74) *Attorney, Agent, or Firm*—Joseph A. Mancini

(57) ABSTRACT

Method for providing steganography in MIDI files. Present invention provides list steganography algorithms and methods for their application to MIDI files. Present invention further provides a 300% increase in average encoding rate and better implementation of stego-keys is achieved over previous MIDI steganography methods.

9 Claims, 3 Drawing Sheets

| n-simulnote | the order ⇔ bit string |
|---|---|
| 2-simulnote | 12 ⇔ 0<br>21 ⇔ 1 |
| 3-simulnote | 123 ⇔ 00<br>132 ⇔ 01<br>213 ⇔ 10<br>231 ⇔ 11<br>312 ⇔ unused<br>321 ⇔ unused |
| 4-simulnote | 1234 ⇔0000<br>1243 ⇔0001<br>1324 ⇔0010<br>1342 ⇔0011<br>1423 ⇔0100<br>1432 ⇔0101<br>2134 ⇔0110<br>2143 ⇔0111<br>2314 ⇔1000<br>2341 ⇔1001<br>2413 ⇔1010<br>2431 ⇔1011<br>3124 ⇔1100<br>3142 ⇔1101<br>3214 ⇔1110<br>3241 ⇔1111<br>3412 ⇔ unused<br>3421 ⇔ unused<br>4123 ⇔ unused<br>4132 ⇔ unused<br>4213 ⇔ unused<br>4231 ⇔ unused<br>4312 ⇔ unused<br>4321 ⇔ unused |

| n-simulnote | the order ⇔ bit string |
|---|---|
| 2-simulnote | 12 ⇔ 0<br>21 ⇔ 1 |
| 3-simulnote | 123 ⇔ 00<br>132 ⇔ 01<br>213 ⇔ 10<br>231 ⇔ 11<br>312 ⇔ unused<br>321 ⇔ unused |
| 4-simulnote | 1234 ⇔0000<br>1243 ⇔0001<br>1324 ⇔0010<br>1342 ⇔0011<br>1423 ⇔0100<br>1432 ⇔0101<br>2134 ⇔0110<br>2143 ⇔0111<br>2314 ⇔1000<br>2341 ⇔1001<br>2413 ⇔1010<br>2431 ⇔1011<br>3124 ⇔1100<br>3142 ⇔1101<br>3214 ⇔1110<br>3241 ⇔1111<br>3412 ⇔ unused<br>3421 ⇔ unused<br>4123 ⇔ unused<br>4132 ⇔ unused<br>4213 ⇔ unused<br>4231 ⇔ unused<br>4312 ⇔ unused<br>4321 ⇔ unused |

FIGURE 2

| # items = $n$ | $n!$ | $\log_2(n!)$ | #bits = $\lfloor \log_2(n!) \rfloor$ | #bytes |
|---|---|---|---|---|
| 1 | 1 | 0 | 0 | 0 |
| 2 | 2 | 1 | 1 | 0.125 |
| 3 | 6 | 2.584962501 | 2 | 0.25 |
| 4 | 24 | 4.584962501 | 4 | 0.5 |
| 5 | 120 | 6.906890596 | 6 | 0.75 |
| 6 | 720 | 9.491853096 | 9 | 1.125 |
| 7 | 5040 | 12.29920802 | 12 | 1.5 |
| 8 | 40320 | 15.29920802 | 15 | 1.875 |
| 9 | 362880 | 18.46913302 | 18 | 2.25 |
| 10 | 3628800 | 21.79106111 | 21 | 2.625 |
| 11 | 39916800 | 25.25049273 | 25 | 3.125 |
| 12 | 479001600 | 28.83545523 | 28 | 3.5 |
| 13 | 6227020800 | 32.53589495 | 32 | 4 |
| ... | ... | ... | ... | ... |
| 165 | 5.4239E+295 | 982.4081214 | 982 | 122.75 |
| 166 | 9.0037E+297 | 989.7831608 | 989 | 123.625 |
| 167 | 1.5036E+300 | 997.1668651 | 997 | 124.625 |
| 168 | 2.5261E+302 | 1004.559183 | 1004 | 125.5 |
| 169 | 4.2691E+304 | 1011.960062 | 1011 | 126.375 |
| 170 | 7.2574E+306 | 1019.369453 | 1019 | 127.375 |

FIGURE 3

MIDI FILE STEGANOGRAPHY

PRIORITY CLAIM UNDER 35 U.S.C. §119(e)

This patent application claims the priority benefit of the filing date of a provisional application Ser. No. 60/579,478 filed in the United States Patent and Trademark Office on Jun. 14, 2004.

STATEMENT OF GOVERNMENT INTEREST

The invention described herein may be manufactured and used by or for the Government of the United States for governmental purposes without the payment of any royalty thereon.

BACKGROUND OF THE INVENTION

Steganography is the art of hiding information. The term literally means "covered writing" and its history and origins pay homage to this definition. Acrostics, invisible inks, semagrams, and microdots (extremely tiny photographs used by the Germans in WW-II) are just a few examples of steganography. Nowadays, steganography is better known for its use in the digital realm. An abundance of computer file formats (used to store such items as text, pictures, sounds, movies, etc.) provides a rich selection of cover objects in which to hide information.

Cryptography and steganography are often compared and contrasted. While they both aim to provide some level of secrecy, "cryptography is about protecting the content of messages, steganography is about concealing their very existence" [2]. One accustomed to cryptography terminology usually does not need an exhaustive explanation on steganography terms because many of the concepts and maxims of steganography are borrowed and transferred directly from cryptography. There are stegosystems that implement secret-key steganography or public-key steganography; instead of crypto-keys there are stego-keys; and even Kerckhoffs' principles apply to stegosystems [2]. The basis of steganography, however, does not lie in mathematics and number theory; rather, it lies in the techniques of unnoticeably altering a cover object.

In implementing these techniques, certain tradeoffs must be made. The most common goals in hiding information are the opposing concepts of detectability, bit rate, and robustness. The goal of detectability is to increase stealth so that it is very difficult to determine if hidden information exists in the cover object. Bit rate, also referred to as encoding rate, may be calculated as (size of embedded data)/(size of cover object)*100%. Its aim is to maximize the amount of information that can be embedded into the cover object. The goal of robustness lies in increasing the ability to recover encoded information even if an interloper has manipulated the cover object (this is the focus of watermarking). Since these goals always oppose each other, they are often represented as a triangle of tradeoffs as shown in FIG. 1 [3].

Practically speaking, there are various aspects to consider when implementing a steganography technique with files. First, the modifications to the cover object file must not be so severe that it no longer functions or serves its purpose—i.e., it must always conform to the cover object's file format standard. Another crucial aspect of any steganography algorithm is that a typical user must not notice that the file has changed. In perception-based multimedia files, this means that the overall "sound" and/or "look" of a music, picture, or movie file must not appear to be any different. Lastly, it is a desired property that the size of the cover object file either does not or very minimally changes in size. All of these factors contribute to the basic necessity of a steganographic algorithm to hide information so as not to arouse suspicion.

The Standard MIDI File Format

The Musical Instrument Digital Interface (MIDI) standard was developed in 1983 to standardize the hardware and communication protocols for controlling digital instruments and synthesizers in a booming electronic music industry. As the MIDI format became more popular, a method of saving raw MIDI data was needed—and so the Standard MIDI File (SMF) format came to fruition.

SMFs are not akin to wav files—MIDI files are more like a musical score that indicates what instrument should play which note at what time and for how long. On the other hand, WAV files are literally waveform data—many discrete samples of the sound waveform.

The details of the SMF specification can be summarized as follows. All SMFs are composed of a header followed by one or more tracks. The header, among other things, defines the type of MIDI file and the number of tracks in the file. Each track contains a series of sequential events. These events may specify music playback information (MIDI events), meta-information (meta-events), or system exclusive messages (sysex events). MIDI events include codes that define when a note is turned "on" and "off," when to perform a pitch bend, what instrument to play, and other music data. Meta-events contain additional information about the music file, including lyrics, copyright notices, track information, key signature, tempo, time information, and more. MIDI hardware devices use sysex events to send information and perform special functions. All event codes specify a corresponding delta-time value, literally the amount of time to wait after the previous event. Therefore, in a group of events that occur at the same time, the first event will have a non-zero delta-time and the rest of the events will have delta-times equal to zero. Most events in a MIDI file are note on and note off events that indicate which instrument the event is for (channel number), the note's pitch (note number) and volume of the note (velocity value). When a note on event occurs, the duration of the note is controlled by the sum of delta-time values between the note on and the corresponding note off event. For additional information on the MIDI specification, consult *The Complete MIDI* 1.0 *Detailed Specification* [4].

Analysis of MIDI Files for Hiding Information

Given some of the characteristics of MIDI files, one may envision some of the potential methods for embedding information within them. Some ideas for MIDI steganography and their tradeoffs follow.

One possible method of embedding information would be to insert additional events that do not affect the sound of the MIDI when it is played. It would be easy to add events that "do nothing" like many note on MIDI events with a velocity/volume value of zero. Meta-events that store text information may also be added to encode information, possibly by just adding raw data. Also, undefined meta-events may be added since the default action (as defined by the Standard MIDI Files specification) is to ignore such meta-event messages and continue parsing the file. This method is very problematic because the original file size would increase significantly (many such events would have to be added to encode a large amount of information). It would be easily detectable since many events that are undefined, events that have no purpose, and text events that do not store information about the music file are very suspicious. Some MIDI writing software even automatically remove superfluous events in a MIDI file by design.

As described above, most meta-events simply store text information. It would be possible to modify existing text fields to encode information, possibly using well-known text steganography techniques for these events. These text fields could be replaced with the data to be embedded, or extra text could be added to them (like white space in the text steganography application "Snow" [5]). Unfortunately, these text fields are typically less than 30 bytes of text and are not widespread in average MIDI files. Using these methods would provide a very low encoding rate. Similarly, these methods are easily detectable, and may increase file size depending on the approach.

Another possibility for embedding information lies in manipulating the least significant bit (LSB) of certain MIDI event data. LSB encoding methods are very common among steganographic algorithms because changing the LSB usually does not affect the user's perception of the object. The best way of carrying out this method in a MIDI file would be to manipulate the velocity (volume) values of a note on MIDI event. These vary from 0 to 127. If the velocity value is decremented or incremented by 1, the slight change in volume will likely be undetectable to the average listener's ears. Analysis of the file, however, would show a variety of values for note on events. This is not a desired behavior since most normal MIDI files, especially those created by music composition software, have standard discrete values that correspond to the musical dynamic notations (from lowest volume to highest volume) ppp, pp, p, mp, mf, f, ff, and fff: Corresponding values vary, but two common practices are to use a logarithmically distributed scale {1, 3, 10, 32, 45, 64, 90, and 127} or an evenly distributed scale {1, 16, 32, 48, 64 (as a "middle" volume), 80, 96, 112, and 127}. Not all MIDI files are created using specialized software, as some are literally recordings of a human playing a MIDI compatible instrument (usually a keyboard) that sends out MIDI events as the musician plays. MIDI files created in such a manner may have significant variations in velocity values, but in practice, few MIDI files are created and publicly released in this fashion. In conclusion, for the case of LSB encoding, the size of the MIDI file would not change, the capacity of embedded data would be good (better than the previously discussed methods), but it would not be stealthy since any velocity value outside of the standard discrete values would be vulnerable to simple analysis.

The most promising method of hiding information in a MIDI file is that of changing the order of simultaneous events. The MIDI specification does not provide guidance as far as which events (that occur at the same time during playback) should be placed before or after other events in the MIDI file. It is assumed that all software programs (and hardware devices) that parse MIDI files will be able to handle simultaneous events in any particular order. Because of this fact, these simultaneous events may be considered a list that can be rearranged without any effect on the playback or function of the MIDI file. As a result, the existing events in the file will not change, nor will their order; so the file size should not increase. Although there is no requirement that certain types of events must appear before others in the file, reordered lists may appear strange because most commercially available music composition software has some sort of method in which events that occur at the same time are organized (meta-events usually occur before MIDI events, note off events usually occur before note on events, etc.). Lastly, this method of reordering events also has the potential for a high encoding rate, depending on the properties of the MIDI file itself

PRIOR ART

After an extensive search, the inventor herein was able to find only two instances of prior work relating to MIDI steganography: Yamaha Corporation's MidStamp watermarking software and the published papers of Inoue and Matsumoto.

The MidStamp software is a utility from Yamaha that assists in protecting copyrighted music in the MIDI file format [6]. Very little information is available regarding this technology other than the press release announcing that such a watermarking technique exists. Apparently Yamaha uses this technology in the MIDI files that are available for purchase on its website, but no technical information on the subject of how the watermark is actually embedded into a MIDI file is available.

The prior work of Inoue and Matsumoto referred to herein is likely the only publicly known reference that addresses a specific technique of hiding information in MIDI files. [1] It proposes an implementation by changing the order of note events that occur at the same time (as discussed above). More specifically, only the note on and note off MIDI events that occur at the same time, referred to as a simulnote, are used. In the actual implementation, 2, 3, or 4 simulnotes are permuted at once. For example, if ten note on events occur at the same time, it is broken up into two 4-simulnotes and one 2-simulnote. The method of embedding information relies on the ability to sort these simulnotes (ranking rules) and to distinguish how the order of a simulnote maps to a specific bit string (stego-key). These ranking rules act as a simple sorting function based on the numeric value of the MIDI events. The stego-key is actually a large table describing what permutations correspond to what bit string. FIG. 2 provides an example. The information depicted in FIG. 2 must be shared between the communicating parties so that the correct embedded information may be recovered.

Several of the design choices given here are problematic for a practical implementation. Only using note on and note off events and only manipulating a maximum of four note events at once handcuffs the encoding rate. As a result, a very low encoding rate of 1% was reported [1]. Also, the manually created stego-key (see FIG. 2) is cumbersome to define and transmit to the communicating parties. No practical method of storing or transferring these stego-keys was given.

What is needed therefore is a method to address these two prior art faults through a much-improved implementation of MIDI steganography. Generic approaches to embedding and extracting information into any type of list are detailed below.

List Steganography

List steganography is defined as the method of hiding information by manipulating the order of a list. Mathematically speaking, in a list with n distinct items, there are n! different ways to order the list. If the list order can be readily changed, then information may be hidden by ordering a list in one of these n! ways.

This technique is not a novel concept, and it has been implemented in freely available software: Matthew Kwan's Gifshuffle and Peter Wayner's List Manipulation Java applet. Gifshuffle implements list steganography by reordering the color palette in a GIF file [7]. The List Manipulation applet, LM1, simply manipulates a list of text items separated by end-of-line characters [8].

Flexible Base Notation

Before explaining the details involving the embedding and extracting of information from a list, a mathematical notation must first be introduced. In Wayner's implementation, he proposes an alternative numeric notation for use in list steganography: flexible base notation [8]. In this notation the ith digit (least-significant digit is the first digit) can take any value from 0 to i, and the multiplicative factor assigned to digit i is i!—hence the term "flexible base." In fixed base notations such as base-10, the multiplicative factor is $10^{i-1}$. For example, in base-10, 4021 is equivalent to $$4\cdot10^3+0\cdot10^2+2\cdot10^1+1\cdot10^0=4000+0+20+1=4021(\text{decimal}).$$

In the flexible base notation, however, 4021 has a different value $$4\cdot4!+0\cdot3!+2\cdot2!+1\cdot1!=96+0+4+1=101(\text{decimal}).$$

Similarly, flexible base value 7251101 is equal to decimal value 7111. This information can be applied to embedding and extracting information in a list. The ith digit in the flexible base notation may be used to indicate placement in a list, as will be explained in the following section.

Algorithms

As an example to explain the processes of embedding and extracting data to and from lists, consider a sample list of five names: {Alice, Bob, Carol, Dave, Eve}. From above, it is known that a list with n distinct items can be ordered in n! different ways; in this case n=5 so these names can be permuted in 5!=120 different ways. This provides a potential data channel since each permutation may represent a different numerical value from 0 through n!−1 (in the above example, this would be 0 through 119).

Extracting Embedded Data

In order to successfully extract information from a list in which data has been embedded (hereinafter "host list") or embed data into a list (hereinafter "original list") there needs to be a method to distinguish among permutations of a list. A way to do this is to create a sorted list to which all other permutations are compared. Given an arbitrary list (hereinafter "original list"), a sorting function may be used to generate the sorted list. In the case of the five names, a simple sorting function would be an alphabetical sort, from A to Z:

0. Alice
1. Bob
2. Carol
3. Dave
4. Eve

This sorted list, numbered from 0 through n−1, provides the basis for comparison among variations of a list and allows the permutations to be converted to numeric values using the flexible base notation.

For example, given the following arbitrary host list permutation within which there is embedded data, its numerical representation can be found:

0. Dave
1. Bob
2. Carol
3. Alice
4. Eve

The first step is to generate a sorted list, and this has already been given as shown above. Next, the numerical position in the host list of "Dave", the first item in the sorted list, is found. In the present example, this yields 3. Note that the possible values of positions in the sorted list are from 0 to n−1. This allows for using this position value in the flexible base notation. In this case, the value of 3 goes into the fourth position of the flexible base number: 3XXX. This item is then removed from the sorted list:

Flexible base value: 3XXX

| Host list: | | | Sorted List: | | New Master List: | |
|---|---|---|---|---|---|---|
| 0. | Dave | ☑ | 0. | Alice | 0. | Alice |
| 1. | Bob | ☐ | 1. | Bob | 1. | Bob |
| 2. | Carol | ☐ | 2. | Carol | 2. | Carol |
| 3. | Alice | ☐ | 3. | Dave | 3. | Eve |
| 4. | Eve | ☐ | 4. | Eve | | |

Continuing in this same fashion, the corresponding flexible base number digit positions and values for Bob, then Carol, and then Alice are calculated:

Flexible base value: 31XX

| Host list: | | | Sorted List: | | New Master List: | |
|---|---|---|---|---|---|---|
| 0. | Dave | ☑ | 0. | Alice | 0. | Alice |
| 1. | Bob | ☑ | 1. | Bob | 1. | Carol |
| 2. | Carol | ☐ | 2. | Carol | 2. | Eve |
| 3. | Alice | ☐ | 3. | Eve | | |
| 4. | Eve | ☐ | | | | |

Flexible base value: 311X

| Host list: | | | Sorted List: | | New Master List: | |
|---|---|---|---|---|---|---|
| 0. | Dave | ☑ | 0. | Alice | 0. | Alice |
| 1. | Bob | ☑ | 1. | Carol | 1. | Eve |
| 2. | Carol | ☑ | 2. | Eve | | |
| 3. | Alice | ☐ | | | | |
| 4. | Eve | ☐ | | | | |

Flexible base value: 3110

| Host list: | | | Sorted List: | | New Master List: | |
|---|---|---|---|---|---|---|
| 0. | Dave | ☑ | 0. | Alice | 0. | Eve |
| 1. | Bob | ☑ | 1. | Eve | | |
| 2. | Carol | ☑ | | | | |
| 3. | Alice | ☑ | | | | |
| 4. | Eve | ☐ | | | | |

The last item in the sorted list, Eve, is ignored because there is no longer a choice of values from the host list. As a result, the flexible base number 3110 was extracted from this host list. In decimal format, this becomes $$3\cdot4!+1\cdot3!+1\cdot2!+0\cdot1!=72+6+2+0=80.$$

This simple host list of five items actually contained an encoded number! A generic algorithm for extracting data, d, from a list of n items may be given as follows.

Extract Algorithm:

1. Use the sort function on the host list to generate a sorted list and its size, n 2. Set data d=0.

3. For each item in the host list (starting from the beginning), do the following:

a. Find this item's position in the sorted list.

b. Multiply the position value by (n−1)!

c. Add the result to d.

d. Remove the item from the sorted list and decrement n.

Embedding Data

Now that an extract algorithm has been defined, a technique for embedding information is also needed. Given an arbitrary original list of size n and data to be embedded, d, the original list must be sorted so that the extract algorithm yields the embedded data. Although basically the opposite of the extract algorithm, it is slightly longer because the positions of each item must first be computed.

Embed Algorithm:

1. Use the sort function on the original list to generate a sorted list and its size, n.

2. Calculate the flexible base representation of the data, d.

For each item in the sorted list, calculate its end position based on d:

a. (n−i−1)th value of flexible base number=d/(n−i)!

b. d=d mod(n−i)!

c. Increment i.

3. Given this flexible base number, for each value in the flexible base:

a. Find the corresponding item in the sorted list.

b. Copy the item from the sorted list so that it is in the ith position in the host list.

c. Remove the item from the sorted list, decrement n, and increment i.

4. Place the last item in the sorted list at the end of the host list.

As a demonstration, the list of names with alphabetical sorted list is still used. (The original list could be of any order.) If it is desired to embed the decimal value 55 into this list, it must be converted to a flexible base notation:

$$55=2\cdot 4!+1\cdot 3!+0\cdot 2!+1\cdot 1!=>2101$$

yielding the flexible base number 2101. As in the extract algorithm, each of the digits in this number refers to a position in the sorted list. Starting with the leftmost digit in the flexible base number, the corresponding item is found in the sorted list and placed into the first position in the host list:

Flexible base value: 2101

| Sorted list: | | Host List: | | Master List: | |
|---|---|---|---|---|---|
| 0. | Alice | 0. | Carol | 0. | Alice |
| 1. | Bob | | | 1. | Bob |
| 2. | Carol | | | 2. | Dave |
| 3. | Alice | | | 3. | Eve |
| 4. | Eve | | | | |

Continuing in this same fashion, items are added to the host list using each consecutive digit in the flexible base number:

Flexible base value: 2101

| Sorted list: | | Host List | | Master List: | |
|---|---|---|---|---|---|
| 0. | Alice | 0. | Carol | 0. | Alice |
| 1. | Bob | 1. | Bob | 1. | Dave |

-continued

Flexible base value: 2101

| Sorted list: | | Host List | | Master List: | |
|---|---|---|---|---|---|
| 2. | Dave | | | 2. | Eve |
| 3. | Eve | | | | |

Flexible base value: 2101

| Sorted list: | | Host List | | Master List: | |
|---|---|---|---|---|---|
| 0. | Alice | 0. | Carol | 0. | Dave |
| 1. | Dave | 1. | Bob | 1. | Eve |
| 2. | Eve | 2. | Alice | | |

Flexible base value: 2101

| Sorted list: | | Host List | | Master List: | |
|---|---|---|---|---|---|
| 0. | Dave | 0. | Carol | 0. | Dave |
| 1. | Eve | 1. | Bob | | |
| | | 2. | Alice | | |
| | | 3. | Eve | | |

The final item in the sorted list is then added to the host list:

Flexible base value: 2101

| Sorted list: | | Host List | | Master List: | |
|---|---|---|---|---|---|
| 0. | Dave | 0. | Carol | | |
| | | 1. | Bob | | |
| | | 2. | Alice | | |
| | | 3. | Eve | | |
| | | 4. | Dave | | |

Therefore, the decimal number 55 has been embedded into the list {Carol, Bob, Alice, Eve, Dave}.

Adding Stego-Keys

Generating the sorted list in the example above was done using a simple sorting function, an alphabetical ranking and placement. Since the method of generating the sorted list in this case is easily replicable, data may be extracted from a list that was embedded using this method. Wayner proposes a more secure implementation involving stego-keys and a cryptographic hash function that is used to generate a master list. [8]

A hash function, h, which takes as input both a stego-key and the actual list item, is needed. Such a function would take the form h(stego-key, list item) and output a bit-string. Such a mechanism has already been implemented: the hashed message authentication code (HMAC) as defined in RFC 2104 [9]. After calculating the HMAC values for each list item, the resulting bit-streams can be used in the sorting function (instead of the list items themselves) to generate the sorted list.

Continuing with current example, stego-keys may now be added. Consider a hash function and stego-keys that result in the following:

| Alphabetically-Sorted list: | | h (stego-key, list value) |
|---|---|---|
| 0. | Alice | 2326584123235754 |
| 1. | Bob | 0235545415167898 |
| 2. | Carol | 9876322103548764 |
| 3. | Dave | 5648742313870591 |
| 4. | Eve | 3245649813208405 |

These hash values can then be used in the sort function. If the sort function is redefined to sort numerically based on the hash result, lowest to highest, instead of alphabetically, it will generate the following sorted list:

| Stego-Kev-Sorted list: | |
|---|---|
| 0. | Bob |
| 1. | Alice |
| 2. | Eve |
| 3. | Dave |
| 4. | Carol |

The addition of stego-keys, although slightly more involved, greatly improves security of the embedded list data by allowing a variety of unpredictable sorted lists.

Working with Bits

Using the above algorithms, it is evident that various numerical values can be embedded into and extract from arbitrary original lists. In the digital steganography realm, it is necessary to embed bits and bytes, rather than decimal values. From above, it is known that any list can store a number from 0 to (n−1)! For the case of n=5, these values range from 0 to 119, or in binary, 0000000 to 1110111. Although the maximum embeddable value is seven bits long, not all seven-bit values can be stored in this list (binary values 1111000 and above). Therefore, the maximum bit string length for this case is six bits. It can be shown that the maximum embeddable bit string length for a list of n distinct items is $\lfloor \log_2(n!) \rfloor$, where $\lfloor\ \rfloor$ is the floor (round down) function. FIG. 3 illustrates the capacity calculations for lists of various sizes.

REFERENCES

[1] D. Inoue and T. Matsumoto, "Standard MIDI Files Steganography," Proc. 1st IEEE Pacific-Rim Conference on Multimedia, pp. 328-321, 2000.

[2] S. Katzenbeisser and F. A. P. Petitcolas. Information Hiding Techniques for Steganography and Digital Watermarking, Boston: Artech House, 2000, ch. 1, pp. 2, 8-9, and ch. 2, pp. 18-24.

[3] D. Robie and R. Mersereau, "Video Error Correction Using Steganography," Journal on Applied Signal Processing, vol. 2002, no. 2, pp. 164-165.

[4] MIDI Manufacturer's Association, The Complete MIDI 1.0 Detailed Specification, Version 96.1, 1996.

[5] M. Kwan. (2001, Mar. 22). The SNOW Home Page. [Online] Available: http://www.darkside.com.au/snow/

[6] Yamaha Corp. MidStamp. [Online] Available: http://www.yamaha.co.jp/english/news/98090302.html

[7] M. Kwan. (2003, Jan. 21). The GifShuffle Home Page. [Online] Available: http://www.darkside.com.au/gifshuffle/

[8] P. Wayner. (2003). Sorting Demonstration. [Online] Available: http://www.wayner.org/books/discrypt2/sorted.php

[9] H. Krawcyzk, M. Bellare, and R. Canetti. (1997, February). HMAC: Keyed-Hashing for Message Authentication. [Online] Available: http://www.ietf.org/rfc/rfc2104.txt

[10] T. Thompson and M. Czeiszperger. (1995). "Midifile" MIDI file parsing software. [Online] Available: http://www.harmony-central.com/MIDI/midifilelib.tar.gz

[11] D. Inoue, M. Suzuki, and T. Matsumoto, "Detection-Resistant Steganography for Standard MIDI Files," IEICE Trans. Fundamentals, vol. E86-A, no. 8, pp. 2099-2106, 2003.

OBJECTS AND SUMMARY OF THE INVENTION

One object of the present invention is to provide a steganographic method for embedding digital data in a Musical Instrument Digital Interface (MIDI) file.

A related object of the present invention is to provide a method for MIDI steganography that fit within the parameters of a MIDI file format, present no change in a user's perception and cause little or no change in MIDI file size.

Another object of the present invention is to embed data in a MIDI file by manipulating the order of a list.

Yet another object of the present invention is to extract embedded data from a MIDI file.

Still another object of the present invention is to embed and extract data in a MIDI file using a hash function overlay.

Still yet another object of the present invention is to compute the capacity of a MIDI file and the corresponding amount of data that can be embedded therein.

The present invention employs list steganography algorithms and methods for their application to MIDI files. Present invention provides a 300% increase in average encoding rate and better implementation of stego-keys is achieved over previous MIDI steganography methods.

According to a feature of the present invention, method for steganographically embedding data in a Musical Instrument Digital Interface (MIDI) file composed of at least one original list of n items, having numerical position values 0 through (n−1), comprises the steps of calculating the capacity of each of the original lists; calculating the total capacity of the MIDI file by summing the capacities of all the original lists; embedding the data within each of the original lists to create a corresponding target list and determining whether all of the original lists have been processed, where, if all of the original lists have not been processed, then retrieving the next original list and returning to the step of embedding, but if all of the original lists have been processed, then saving the MIDI file with embedded data.

According to another feature of the present invention, method for extracting steganographically-embedded data from a Musical Instrument Digital Interface (MIDI) file composed of at least one host list of n items, comprises the steps of calculating the capacity of each of the host lists; calculating the total capacity of the MIDI file by summing the capacities of all of the host lists; extracting data from the host list within which data is embedded; and determining whether all of the host lists have been processed and if all of host lists have not been processed, then retrieving next host list and returning to the step of extracting, but if all of the host lists have been processed, then displaying the extracted data.

According to yet another feature of the present invention, embedding data further comprises the steps of sorting an original list according to a hash function so as to create a corresponding sorted list of n items having numerical position values 0 through (n−1); calculating a flexible base number representation of the data d to be embedded; identifying, for each digit in the flexible base number beginning with the leftmost said digit, the item whose position in the sorted list corresponds to each digit in the flexible base number; copying each identified item to a corresponding host list in the order in which they are identified; removing each copied item from sorted list; shifting remaining items upward in the sorted list and determining whether all digits of the flexible base number have been read where if all digits of the flexible base number have not been read, then returning to said step of identifying but if all of the digits of the flexible base number have been read then placing the last item in the sorted list at the end of the host list.

According to still yet another feature of the present invention, extracting data further comprises the steps of setting data d to an initial value of zero 0; sorting the host list according to a hash function so as to create a sorted list of n items; identifying, for each item in the sorted list, its numerical position in host list; multiplying the numerical position by (n−1)! and adding to d; removing the identified item from the host list; numerically decrementing n by 1; and determining whether (n−1) items in the sorted list have been identified; and if (n−1) items in the sorted list have not been identified, then returning to the step of identifying, but if (n−1) items in the sorted list have been identified, then displaying said data d.

BRIEF DESCRIPTION OF THE DRAWINGS

FIG. 2 depicts 2, 3, and 4 simulnote stego-key permutations.

FIG. 3 depicts host file capacity for embeddable bit strings versus list size.

DETAILED DESCRIPTION OF THE PREFERRED EMBODIMENT

Figure 1:
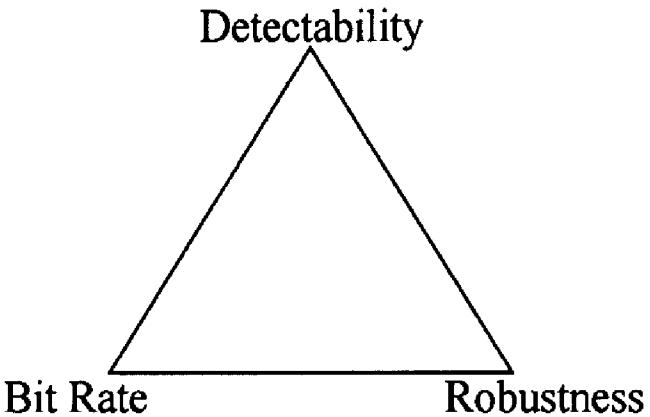
FIG. 1 depicts the tradeoffs in information steganography.

The present invention relates to a method for MIDI file implementation of list steganography. The present invention improves upon the prior art [1] by addressing many of its shortcomings, specifically focusing on maximizing steganographic capacity and implementing more manageable stego-keys.

Two major actions can help with maximize encoding rates: changing file type and increasing event use. The header for all MIDI files defines the file's "type," ranging from 0 to 2 [3]. Nearly all MIDI files are type-0 or type-1, since the type-2 format never gained popularity. In a type-1 file, the file is divided up into multiple simultaneous tracks, each of which usually only contains events for one instrument; this yields small lists and therefore small capacities. Type-0 files, on the other hand, have only one track that contains all events; these files have large lists and therefore larger steganographic capacities. By converting type-1 files to type-0 files, the maximum embeddable data size is increased (without changing the "sound" of the file). Inoue and Matsumoto restricted the types of events considered in a list to be only note on and note off events. Although these events comprise the majority of a MIDI file, more capacity may be gained by including all possible types of events in a MIDI file.

In an above discussion "Adding Stego-keys," it was demonstrated that stego-keys could be easily included into list steganography through HMAC functions. Specifically, this MIDI steganography program implements the HMAC SHA-1 algorithm for calculating hash values and generating a master list. As a result, the (recommended) size of the stego-keys is 20 bytes [9]. This 20-byte value must be shared between the sender and receiver of the steganographic MIDI file; this is a far superior stego-key than the tabular solution (a large table of list orders corresponding to specific values) provided by [1].

Specific Issues with MIDI File Steganography

First and foremost, methods for reading, parsing, rearranging, and writing a MIDI file are necessary to implement MIDI steganography. The freely available "midifile" library is a small and highly portable (written in C) solution that provides such functionality [10]. Although a bit dated, only a few changes and updates were necessary for compliance with the most recent Standard MIDI Files specification.

As previously described, events occurring at the same time in a MIDI file may be considered a list. Average MIDI files may have hundreds or thousands of such lists. Depending on the style of music and how the MIDI file was composed, a list of events occurring at one time may number between one and twenty, or even higher. In practice, few MIDI files have any lists over 100 items, but significant numbers of events in one list are possible. (One publicly downloadable MIDI file was found to have over 350 events in one list!) Clearly, problems may arise in calculating $\lfloor \log_2(n!) \rfloor$ and in implementing the embed and extract algorithms. For example, a 64-bit integer cannot be used to calculate factorials of n greater than 20, so a method of handling extended precision integers (from addition, subtraction, multiplication, division, bit-shifts, and logarithm base-2) is necessary. To achieve this goal, the extended precision integer functions used in the Gifshuffle program (located in epi.c) were borrowed and highly modified [7].

If any significant amount of data is to be embedded, more than one of these lists must be used to span the embedded information. This may be termed multiple-list steganography. To calculate the capacity of an entire MIDI file, individual list's capacity is calculated and summed. In the MIDI steganography program, the following C code provides this functionality.

```
unsigned long capacity( )
{
    int n = 1;
    unsigned long current_time, previous_time, total_capacity = 0L;
    struct MIDIpacket *current = sequence_start;
    previous_time = current->time;
    current = current->next;
    while (current != 0L)
    {
        current_time = current->time;
        if (current_time == previous_time)
            n++;
        else if (n > 1)
        {
            EPI big_int;
            if (n > 536)
                n = 536; // max size of extended precision
                integer < 537!
            epi_set(&big_int, n);
            while (n > 2)
                epi_multiply(&big_int, --n);
                total_capacity += big_int.epi_high_bit - 1;
                n = 1;
            }
            previous_time = current_time;
            current = current->next;
        }
        return total_capacity;
    }
```

While embedding information, the capacity of each list is first calculated and the corresponding number of bits is stripped off from the data to be embedded until no bits remain. Similarly, when extracting, each list's capacity must be calculated and that number of bits may be written appended to the output file. During the extract process, however, the number of bits of embedded data must be known—otherwise, data will be extracted from all lists in the MIDI file and incorrect data will be concatenated to the true embedded data. Inserting additional data (a header containing the size of the embedded file and its 8.3 format file name) during the embedding process solves this problem.

It is possible that some events occurring at the same time in a MIDI file may be non-distinct items. Pitch bend events were the only such events found during analysis. This clearly presents a problem to the list steganography algorithms since placement (which is not determinable when identical items exist) is the method of calculating data values. Although the possibility for embedding additional information may exist (by choosing one of the various permutations that the non-distinct items may be positioned within the list), this is not a desired addition. In practice, identical pitch bend events are always positioned together in a MIDI file, and dispersing them might arouse some suspicion. Also, employing this additional technique would greatly complicate the list algorithms for little reward in increased capacity. Therefore, all non-distinct events in one list will be grouped together and treated as one item in this implementation.

Evaluation

The above algorithms and designs were implemented in C for Win32 platforms using the Microsoft Visual Studio environment. The program was tested with a variety of downloaded MIDI files as cover objects and an assortment of files as secret data.

One of the primary goals of the present invention is to increase the average potential encoding rate of MIDI files. In evaluating the present invention, over 1300 MIDI files were downloaded and capacities calculated, yielding an average raw encoding rate of 3%! This is triple that of the reported 1% average encoding rate in [1].

One of the interesting details that arose in the course of evaluating the present invention was that the capacity of any particular MIDI file is highly variable. For example, it was found that one MIDI file of size 19600 bytes had a capacity of 2049 bytes (a 10.5% encoding rate), while another MIDI file with a slightly larger file size of 20066 bytes only had a capacity of 60 bytes (a 0.3% encoding rate). Because capacity depends upon the number and size of lists within the MIDI file, many musical characteristics affect the encoding rate. Properties such as the style of music represented in the file, how complex the music is, how it was composed, how many instruments are used, the use of chords and notes in unison, etc. are all factors in the size of lists in a MIDI file.

Limitations

One of the major limitations of the present invention (or any such method for embedding data) is that some MIDI files will increase in size after embedding data. This is partially the fault of the list steganography algorithms, but more the fault of using a simplistic MIDI library that does not support the use of "running status" when writing MIDI files. Running status is the method of omitting a MIDI status byte if the previous MIDI message was of the same type. This results in a smaller file size than if running status was not used. Since the MIDI file library used to implement the present invention does not support running status when writing files, all files that use running status (whether data was embedded or not) are a larger size when written to file. Secondly, even if running status were supported, the cover file's size will likely increase if the list orders are changed. The prior art [1] has also indicated such a problem, but there is not as yet a clear practical solution.

Although this is a tradeoff in any steganography method, emphasis on increasing capacity in this method has decreased stealthiness. [11] introduced a method of creating detection-resistant MIDI steganography by breaking up lists into meta-events lists followed by MIDI event lists. Although this slightly decreases the capacity of the file, it may be a desired tradeoff at times and this functionality should be added. Similarly, the method of embedding information in the lists sequentially (from beginning of file until all data has been embedded) would be very detectable because the part of the file with embedded information will have a different appearance than the rest of the file without hidden data. This problem might possibly be addressed by developing an algorithm that predictably "randomizes" where in the file (which lists) will be used for embedding data and in what order. This would disperse lists that may look slightly unusual throughout the file instead of being located together at the beginning of the file.

Possible Improvements

A primary improvement to the present invention would involve mitigation of the "running status" effect as described previously. Fixing the MIDI file library to correctly write MIDI files with running status should minimize the amount of file size increase. Further investigation should be performed to determine what might be done to ensure that the file size does not increase at all.

The present embodiment of the present invention has only a command-line interface. A graphical user interface should be constructed so that the tool may be user-friendly and have a professional appearance.

In the present embodiment, only MIDI files, with an extension of mid, are supported. A file format closely related the MIDI file format is the RMI (RIFF MIDI) format. It would be trivial within the scope of this art to implement full support for RMI files since the file format is simply a MIDI file encapsulated in a RIFF (Resource Interchange File Format) chunk.

The prior art [11] has proposed various rules for steganalysis but does not provide source code. A MIDI file steganalysis tool should be implemented and the MIDI steganography algorithms should be tested.

The present invention should allow for user-defined granularity in providing more/less stealthiness, thereby less/more capacity. Stealthier implementation rules given by [11] may be used. For increased capacity, encoding the file extension only (not the 8.3 file name representation) would minimize the header information; this allows for more of the capacity to be used for the actual embedded file and not the header information. Also, permutations of non-distinct items may be used to embed even more information into those lists containing identical items. Other potential techniques for increasing capacity might include using some of the steganography methods that were rejected in section 2—perhaps the LSB encoding method for velocity values in note on events.

Lastly, a survey of file formats and other digital storage methods should be conducted to determine which might be candidates for list or multiple-list type steganography contemplated by the present invention. The most promising candidate should be selected and incorporated into an embodiment of the present invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A computer readable medium containing a computer executable program for steganographically embedding data in a Musical Instrument Digital Interface (MIDI) file composed of at least one original list of n items, having numerical position values 0 through (n−1), wherein said executable program, when read, will cause a computer to perform the steps of:

calculating the capacity of each of said at least one original lists of said MIDI file;

calculating the total capacity of said MIDI file by summing said capacities of all said at least one original lists;

embedding said data within each of said at least one original lists of said MIDI file to create at least one host list; and determining whether all of said at least one original lists of said MIDI file have been processed; and IF all of said at least one original lists of said MIDI file have NOT been processed, THEN retrieving next said at least one original list of said MIDI file;

returning to said step of embedding;

OTHERWISE, saving a transformed version of said MIDI file with steganographically embedded data.

2. A computer readable medium containing a computer executable program for extracting steganographically-embedded data from a Musical Instrument Digital Interface (MIDI) file composed of at least one host list of n items, wherein said executable program, when read, will cause a computer to perform the steps of:

calculating the capacity of each of said at least one host list of said MIDI file;

calculating the total capacity of said MIDI file by summing said capacities of all said at least one host lists of said MIDI file;

extracting said data from said at least one host list of said MIDI file within which data is embedded; and determining whether all of said at least one host lists of said MIDI file have been processed; and IF all of said at least one host lists of said MIDI file have NOT been processed, THEN retrieving next said at least one host list of said MIDI file;

returning to said step of extracting;

OTHERWISE, displaying extracted data.

3. Computer readable medium containing a computer executable program of claim 1, wherein said step of embedding data further comprises the steps of:

sorting said at least one original list of said MIDI file according to a hash function so as to create a corresponding sorted list of n items having numerical position values 0 through (n−1);

calculating a flexible base number representation of the data d to be embedded;

identifying, for each digit in said flexible base number beginning with the leftmost said digit, the item whose position in said sorted list corresponds to said each digit in said flexible base number;

copying each said identified item to a corresponding host list in the order in which they are identified;

removing each said copied item from said sorted list;

shifting remaining items upward in said sorted list;

determining whether all digits of said flexible base number have been read; and

IF all digits of said flexible base number have NOT been read, THEN returning to said step of identifying;

OTHERWISE, placing the last item in said sorted list at the end of said host list.

4. Computer readable medium containing a computer executable program of claim 2, wherein said step of extracting data further comprises the steps of:

setting data d to an initial value of zero 0;

sorting said at least one host list according to a hash function so as to create a sorted list of n items;

identifying, for each item in said sorted list, its numerical position in said at least one host list;

multiplying said numerical position by (n−1)! and adding to d;

removing said identified item from said at least one host list;

numerically decrementing n by 1; and determining whether (n−1) said items in said sorted list have been identified; and IF (n−1) said items in said sorted list have NOT been identified, THEN returning to said step of identifying;

OTHERWISE, displaying said data d.

5. Computer readable medium containing a computer executable program of claim 3, wherein said step of sorting according to a hash function further comprises the steps of:

stripping off a number a bits of said data, said number of bits being equal to said capacity of said at least one original list;

for each said item in said at least one original list, computing an output bit string from a hash function, said hash function being a function of a stego-key and said list item from said at least one original list; and ordering said output bit strings.

6. Computer readable medium containing a computer executable program of claim 4, wherein said step of sorting according to a hash function further comprises the steps of:

stripping off a number a bits of said data, said number of bits being equal to said capacity of said at least one host list;

for each said item in said at least one host list, computing an output bit string from a hash function, said hash function being a function of a stego-key and said list item from said at least one host list; and ordering said output bit strings.

7. Computer readable medium containing a computer executable program as in either of claims 1 or 2, wherein said step of calculating the capacity of each of either said at least one original lists of said MIDI file or said at least one host lists of said MIDI file substantially comprises the following computer-implementable steps:

```
unsigned long capacity( )
{
  int n=1;
  unsigned long current_time, previous_time, total_capacity=0 L;
  struct MIDIpacket*current=sequence_start;
  previous_time=current->time;
  current=current->next;
  while (current !=0 L)
  {
```

```
    current_time=current->time;
    if (current_time==previous_time)
      n++;
    else if (n>1)
    {
      EPI big_int;
      if (n>536)
        n=536; //max size of extended precision inte-
        ger<537!
      epi_set(&big_int, n);
      while (n>2)
        epi_multiply(&big_int, --n);
      total_capacity+=big_int.epi_high_bit-1;
      n=1;
    }
    previous_time=current_time;
    current=current->next;
  }
  return total_capacity;
}.
```

8. Computer readable medium containing a computer executable program of claim 7, wherein said computer-implementable steps are represented in C-programming language.

9. Computer readable medium containing a computer executable program of claim 3, wherein said step of calculating said flexible base number further comprising the steps of for each said item in said sorted list, calculating its end position based on said data d to be embedded, said step of calculating further comprising:

a first step of calculating d/(n−i)! to yield the $(n-i-1)^{th}$ value of said flexible base number;

a second step of calculating d=d mod(n−i)!;

incrementing i by 1;

determining whether i=n; and

IF i≠n, THEN returning to said first step of calculating;

OTHERWISE, saving said flexible base number.

* * * * *